US005156831A

United States Patent [19]

Fain et al.

[11] Patent Number: 5,156,831

[45] Date of Patent: Oct. 20, 1992

[54] METHOD FOR PRODUCING HIGH STRENGTH, MELT SPUN CARBON FIBERS

[75] Inventors: Charles C. Fain; Danny D. Edie, both of Clemson, S.C.

[73] Assignee: Clemson University, Clemson, S.C.

[21] Appl. No.: 34,226

[22] Filed: Apr. 2, 1987

Related U.S. Application Data

[62] Division of Ser. No. 820,734, Jan. 21, 1986.

[51] Int. Cl.[5] ..... D01F 9/12

[52] U.S. Cl. ..... 423/447.1; 423/447.4; 423/447.6; 264/29.2

[58] Field of Search ..... 423/447.1, 447.2, 447.4, 423/447.6; 264/29.2, 177.13, 177.14

[56] References Cited

U.S. PATENT DOCUMENTS

| | | | |
|---|---|---|---|
| 3,478,389 | 11/1969 | Bradley et al. | 423/447.1 |
| 3,600,491 | 8/1971 | Shimada et al. | 264/177.14 |
| 3,715,422 | 2/1973 | Chopra et al. | 264/177.13 |
| 3,949,115 | 4/1976 | Tamura et al. | 264/29.2 |
| 4,016,247 | 4/1977 | Otani et al. | 423/447.4 |
| 4,017,327 | 4/1977 | Lewis et al. | 423/447.1 |
| 4,208,267 | 6/1980 | Diefendorf et al. | 423/447.1 |
| 4,402,928 | 9/1983 | Lewis et al. | 423/447.2 |
| 4,461,855 | 7/1984 | Phillips | 423/447.1 |
| 4,628,001 | 12/1986 | Sasaki et al. | 423/447.1 |

FOREIGN PATENT DOCUMENTS

| | | | |
|---|---|---|---|
| 0219964 | 4/1987 | European Pat. Off. | 264/29.2 |
| 2542329 | 9/1984 | France | 423/447.1 |
| 56-188464 | 11/1982 | Japan | 423/447.1 |
| 58-91826 | 5/1983 | Japan | 423/447.1 |
| 59-168126 | 9/1984 | Japan | 423/447.1 |
| 58-209857 | 5/1985 | Japan | 423/447.1 |
| 1310769 | 3/1973 | United Kingdom | 423/447.1 |

OTHER PUBLICATIONS

Singer, Leonard S., "The Mesophase and High Modulus Carbon Fibers from Pitch," Carbon, vol. 16, pp. 409–415 (1978).

Berg, et al, "Friction and Wear of Graphite Fiber Composites," NBS Journal of Research, vol. 76C, Nos. 1 and 2, Jun. 1972.

Singer, Leonard S., "Carbon Fibers From Mesophase Pitch," Fuel, vol. 60, Sep. 1981, pp. 839–847.

*Primary Examiner*—Robert Kunemund

*Attorney, Agent, or Firm*—Dority & Manning

[57] ABSTRACT

Hollow carbon fibers and carbon fibers having a generally C-shaped transverse cross-sectional area are produced by extruding a carbonaceous anisotropic liquid precursor through a spinneret having a capillary with a generally C-shaped cross-sectional area, into a fiber filament, controlling the viscosity of the molten precursor, the pressure of the molten precursor and the linear take-up speed of the filament to yield a fiber filament having a cross-sectional area shaped substantially like the shape of the cross-sectional area of the capillary and further having a line-origin microstructure, rendering the filament infusible, heating the filament in an inert pre-carbonizing environment at a temperature in the range of 600° C. to 1000° C. for 1 to 5 minutes, and heating the filament in an inert carbonizing environment at a temperature in the range of 1550° C. to 1600° C. for 5 to 10 minutes, to substantially increase the tensile strength of the filament. The carbon fiber filament so produced has a line-origin microstructure in which the origin line is located and shaped substantially as a line which constitutes the line formed by uniformly collapsing the perimeter of the transverse cross-sectional area of the fiber filament upon itself. The carbon fiber filament has a tensile strength greater than 200 ksi and as high as the 700 to 800 ksi range, yet a modulus of elasticity on the order of 25–35 msi. The top to bottom outside diameter of the fiber's transverse cross-sectional area is on the order of 30 to 50 microns, and the wall thicknesses are on the order of 8 to 15 microns.

20 Claims, 8 Drawing Sheets

METHOD FOR PRODUCING HIGH STRENGTH, MELT SPUN CARBON FIBERS

This is a division of application Ser. No. 06/820,734 filed Jan. 21, 1986, pending.

BACKGROUND OF THE INVENTION

This invention relates to carbon fibers and to a method for producing same, and particularly to high strength, melt spun carbon fibers and method for producing same.

There are many commercial uses for fibers which are high in strength and light in weight. Carbon/graphite (C/G) fibers exhibit such high strength and light weight mechanical properties.

The mechanical properties of C/G fibers depend upon how well their structure resembles the anisotropic structure of an ideal, i.e., perfect, graphite crystal. As shown schematically in FIG. 3, the three dimensional lattice structure of an ideal graphite crystal is basically a network of hexagonal crystal planes stacked one on top of the other with an orientation such that within each layer covalent carbon-carbon bonds link individual graphite crystals together in the plane. These strong bonds give graphite its high strength characteristics in the direction parallel to these planes. Each layer of hexagonal crystal planes is perfectly parallel to its adjacent planes. Because these planes are perfectly parallel to one another, the interlayer spacing is very small, and consequently the ideal graphite crystal has a very high density. The closeness of these parallel planes gives graphite a high stiffness characteristic. A perfect crystal has a theoretical tensile modulus of elasticity of 146 million pounds per square inch (msi), and a theoretical ultimate tensile strength of 15 msi.

Commercially produced C/G fibers differ from the perfect crystals of an ideal graphite lattice structure due to both surface and internal flaws and in the lesser amount of preferred orientation along the fiber axis, which is in the direction parallel to the hexagonal crystal planes. Structural flaws effect the ultimate tensile strength, and the degree of preferred orientation along the fiber axis affects the tensile modulus of elasticity.

Carbon/graphite fibers have been produced from a number of different precursor materials. One such material is polyacrylonitrile (PAN), which is described as an atactic linear polymer whose fibril 3-D network tends to form an irregular helix structure, which is generally designated in FIG. 1 by the numeral 50.

A typical process for producing PAN-based C/G fibers is shown schematically in FIG. 1. Typically, the as-spun fiber is obtained by wet spinning PAN or its copolymers into a coagulation bath. The purpose of using a copolymerized precursor is to lower the glass transition temperature, thereby allowing the as-spun fiber to be stretched in liquids which boil at lower temperatures. The as-spun helical fiber is stretched to better orient the polymer molecules along the fiber axis. It is thought that oxidation of the stretched fiber maintains the preferred orientation along the fiber axis by cyclization of the nitrile groups as shown in FIG. 1. Suggested temperatures for oxidation are 220°–270° C. for up to seven hours. Most of the non-carbon elements are driven off in gaseous form during the carbonization step, which occurs in an inert atmosphere between 1000° and 1500° C. Stretching the fiber during carbonization also improves the strength and stiffness of PAN-based carbon fibers. A further heat treatment step can be performed at temperatures between 1800° and 2500° C. for less than one hour to purify and provide a higher degree of preferred orientation of the 3-D turbostratic structure.

The modulus of elasticity of PAN-based C/TG fiber increases with heat treatment temperature, but the tensile strength reaches a maximum value of approximately 450 ksi at a temperature of approximately 1600° C. Surface flaws in the as-spun PAN-based fiber may be retained throughout the entire process and limit fiber strength. Internal flaws caused by voids left by rapidly evolving gasses may occur during heat treatment and cause a decrease in tensile strength with higher temperatures. Moreover, the stretching required to obtain the desired strength characteristics is time-consuming and expensive in commercial production.

Since PAN will thermally decompose prior to melting, a solution of PAN in a solvent such as dimethyl formamide is normally spun into a filament using either a "wet" solution spinning technique, as described above, or a "dry" solution spinning technique. In both wet and dry spinning, the solvent must diffuse through the filament and then evaporate into the spinning chamber (dry spinning) or enter the coagulating bath solution (wet spinning). If the rate of evaporation of the solvent (or the rate of loss of solvent into the coagulating bath) is less than the rate of diffusion of the solvent through the PAN filament, the filament will dry uniformly and the filament will have a circular cross-section. However, if the rate of loss of solvent at the filament surface is greater than the rate of diffusion of solvent through the filament, then the surface of the filament will harden faster than the core, and a fiber having a collapsed, dogbone-shaped cross-sectional area will result. Thus, it is this balance between mass transfer away from the fiber and diffusion within the fiber which normally governs the shape of the fiber's cross sectional area in PAN spinning processes. The precipitation process required to produce a PAN fiber limits the possible non-circular cross-sections which can be produced and stably controlled in a commercial process.

A PAN-based carbon fiber having a dogbone-shaped cross-section is observed to be lower in strength than PAN-based fibers of circular cross-section. PAN-based fibers having a trilobal cross-section also is observed to be weaker than PAN-based fibers of circular cross-section. The strength of PAN-based fiber of circular cross-section decreases with higher carbonizing temperature. However, there is some evidence in the literature that dogbone-shaped PAN-based fiber becomes higher in strength with higher carbonizing temperature.

Pitch, whether natural in origin, such as coal tar or petroleum pitch, or synthetic in origin, such as specially prepared polyvinylchloride (PVC), has been used as a precursor for producing a melt spun C/G fiber. Pitch, a graphitizable substance, is a collection of hydrocarbons ranging from low molecular weight paraffins to high molecular weight large aromatics. A graphitizable substance has been defined as one which fuses or becomes plastically deformed during heat treatment. According to this definition, rayon-based and PAN-based C/G fibers are not graphitizable. While they may set up in a turbostratic configuration, rayon and PAN are incapable of forming he characteristic three dimensional structure of graphite.

As discussed in this patent application, graphite fibers are considered to be those fibers which have been heat-treated above 1700° C. and have a carbon content of at least 99 percent. The typical graphite structure is shown in FIG. 3. Carbon fibers are those fibers which have been heat-treated below 1700° C. and have a carbon content of between 80 and 95 percent.

It has been reported that upon heating graphitizable substances such as pitch materials, the original material melts or fuses to form an isotropic pitch-like mass. As heating continues, spherical bodies begin to form. The spherical bodies are of an anisotropic liquid crystalline nature as viewed under polarized light. These spheres continue to grow and coalesce until a dense continuous anisotropic phase forms, which phase has been termed the "mesophase." Thus, the mesophase is the intermediate phase or liquid crystalline region between the isotropic pitch and the semi-coke obtainable at higher temperatures.

U.S. Pat. No. 4,208,267 discloses a method for producing mesophase pitch-based C/G fibers in which a nearly 100 percent mesophase pitch precursor is melt spun. This method is illustrated schematically in FIG. 2. The nearly 100 percent mesophase precursor is prepared by converting a solvent-insoluble fraction of isotropic pitch into an anisotropic pitch containing between 75 and 100 percent mesophase by heating to between 230° to 400° C. for less than ten minutes. For the most part, it is the large aromatics which convert to eh mesophase upon heating. The solvent-insoluble fraction is pelletized as a solid and then melt spun through a conventional screw extruder at spin temperatures of between 360° to 370° C. to produce a fiber filament of circular cross-section. Typical viscosities for the mesophase precursor at such spinning temperatures range between 200 and 700 poise.

If the as-spun circular fibers produced from the mesophase were immediately subjected to carbonizing temperatures, the fibers would degrade and lose their anisotropic molecular orientation. To avoid loss of orientation, the as-spun fibers are thermoset at 200° to 350° C. in an oxygen atmosphere. After this oxidation step, carbonization/graphitization is accomplished in a horizontal graphite resistance furnace at temperatures between 1000° and 2000° C. under a nitrogen atmosphere.

It has been thought that the orientation which is imparted to the mesophase during spinning gives rise to the graphitic orientation developed in the fiber during the carbonizing steps. As the molecularly random mesophase precursor flows through the spinneret capillary, a certain amount of order is produced such that the liquid crystals preferentially orient themselves along the longitudinal axis of the fiber. Accordingly, the costly process of high tension heat treatment is not needed by mesophase pitch-based C/G fibers to induce preferred alignment.

Commercial producers of synthetic fibers have produced non-circular synthetic fibers from melt spun polymers, such as polyester, nylon and polypropylene, for about 20 years. The extrusion process is identical to the one used to produce circular synthetic fibers, except that spinnerets with non-circular capillaries are used rather than ones with circular capillaries.

Polymers have a relatively large range of temperatures over which the viscosity of the polymer is suitable for producing a melt spun fiber, whether circular or non-circular in cross-section. A polymer such as polystyrene shrinks during the draw-down process of melt spinning under typical commercial conditions, from a diameter of about 700 microns to a final diameter of about 40 microns over a distance of about 40 millimeters. This distance is sometimes referred to as the quench distance and is a critical parameter in obtaining a non-circular polymer fiber.

For many materials, surface tension is the single most important obstacle to overcome in melt spinning non-circular fibers. For example, the high surface tension of glass has prevented commercial production of non-circular glass fibers. Polymers, on the other hand, more readily lend themselves to being spun into a C-shaped or annular fiber because polymers have a relatively low surface tension.

Several factors reduce the likelihood that C-shaped or hollow carbon fibers can be produced by melt spinning an anisotropic precursor such as mesophase pitch. First, anisotropic precursors have a surface tension between that of glass and that of polymers. In addition, the quench distance for a circular carbon fiber produced from an anisotropic precursor is approximately 4 mm over which a 200 micron diameter is drawn down to a twelve micron diameter. Third, the viscosity of an anisotropic precursor is far more temperature dependent than the viscosity of polymers.

OBJECTS AND SUMMARY OF THE INVENTION

It is a principal object of the present invention to provide a carbon fiber of improved tensile strength and modulus of elasticity over presently available carbon fibers.

It is also a principal object of the present invention to provide a method of producing carbon fibers having improved tensile strength characteristics and an improved modulus of elasticity over presently available carbon fibers.

Another object of the present invention is to provide a method of producing carbon fibers of high tensile strength by carbonizing same at lower temperatures than the carbonizing temperatures required to produce conventional carbon fibers of comparable tensile strength.

A further object of the present invention is to provide a method of producing carbon fibers having improved tensile strength characteristics and an improved modulus of elasticity over presently available carbon fibers produced at the high end of the range of carbonization treatment temperatures.

One of the objects of the present invention is to provide a method of producing carbon fibers having comparable or greater tensile strength characteristics and improved modulus of elasticity as conventional carbon fibers of lesser mass and volume.

Still another object of the present invention is to provide a method of producing carbon fibers having comparable or greater tensile strength as conventional carbon fibers, that is simpler and less expensive than conventional methods.

Another object of the present invention is to provide a C-shaped carbon fiber of improved tensile strength and modulus of elasticity over presently available carbon fibers.

An additional object of the preset invention is to provide a method of producing C-shaped carbon fibers having improved tensile strength characteristics and an improved modulus of elasticity over presently available carbon fibers.

A further object of the present invention is to provide a hollow carbon fiber of improved tensile strength and modulus of elasticity over presently available carbon fibers.

A still further object of the present invention is to provide a method of producing hollow carbon fibers having improved tensile strength characteristics and an improved modulus of elasticity over presently available carbon fibers.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method for producing a high elastic modulus, high tensile strength carbon fiber comprises: providing a molten precursor containing a substantial proportion of carbonaceous anisotropic material; extruding the molten precursor, the pressure of said molten precursor, through a spinneret defining a capillary having a generally C-shaped cross-sectional area, into a fiber filament; controlling the viscosity of the molten precursor and the linear take-up speed of the filament to yield a fiber filament having a transverse cross-sectional area shaped substantially like the shape of the transverse cross-sectional area of the capillary and further having a line-origin microstructure rendering the fiber filament infusible; and carbonizing the fiber filament.

The step of rendering the fiber filament infusible preferably includes maintaining the filament in an oxidizing environment for a period of time in the range of approximately 1 to 5 hours and wherein the temperature of the oxidizing environment falls within the range of approximately 265° C. to 350° C.

The step of carbonizing the fiber filament may include a pre-carbonizing step of heating the filament preferably in an inert pre-carbonizing environment for a period of approximately 1 to 5 minutes, wherein the pre-carbonizing environment has a temperature preferably within the range of approximately 600° C. to 1000° C.

The step of carbonizing the fiber filament preferably includes the step of heating the filament in an inert carbonizing environment for a period of approximately 5 to 10 minutes, the carbonizing environment having a temperature in excess of approximately 1550° C.

The objects and purpose of the present invention also are accomplished by a carbon fiber filament according to the method described above. The carbon fiber filament of the present invention has a tensile strength greater than 200 thousand pounds per square inch (ksi) and preferably greater than 600 ksi, a modulus of elasticity in the range of 25 to 35 million pounds per square inch (msi) either a generally C-shaped cross-sectional area or an annular-shaped cross-sectional area, an outside diameter preferably in the range of 30 to 50 microns, and a line-origin microstructure. The origin line of the microstructure is located and shaped substantially as would a line which constitutes the line formed by uniformly collapsing the perimeter of the transverse cross-sectional area of the fiber filament upon itself.

The accompanying drawings, which are incorporated in and constitute a part of this specification, illustrate the embodiments of the invention and, together with the description, serve to explain the principles of the invention.

BRIEF DESCRIPTION OF THE DRAWINGS OF THE PREFERRED EMBODIMENTS

Figure 6A:
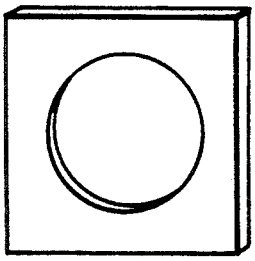
FIG. 6a (PRIOR ART)
Figure 8:
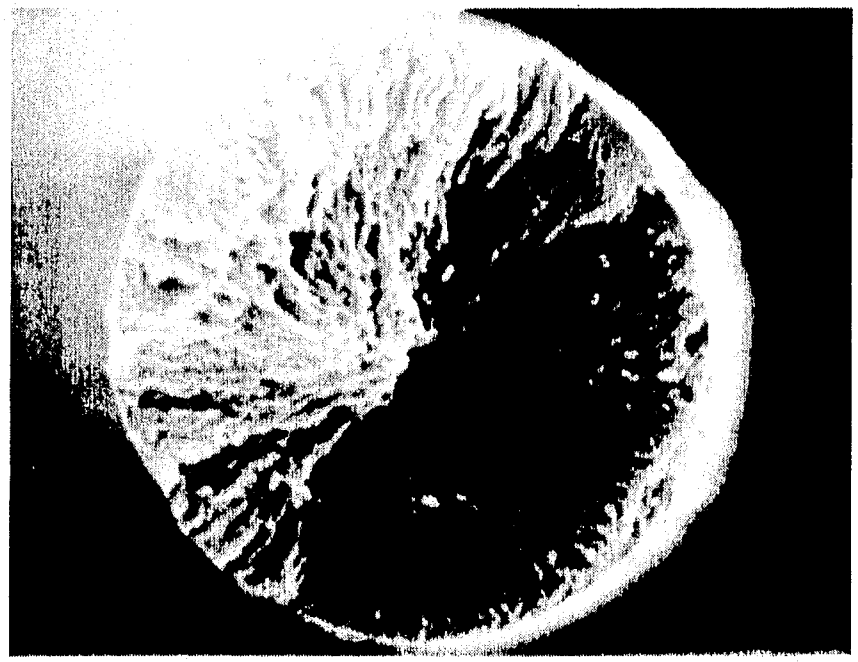
FIG. 8 (PRIOR ART)
Figure 9:
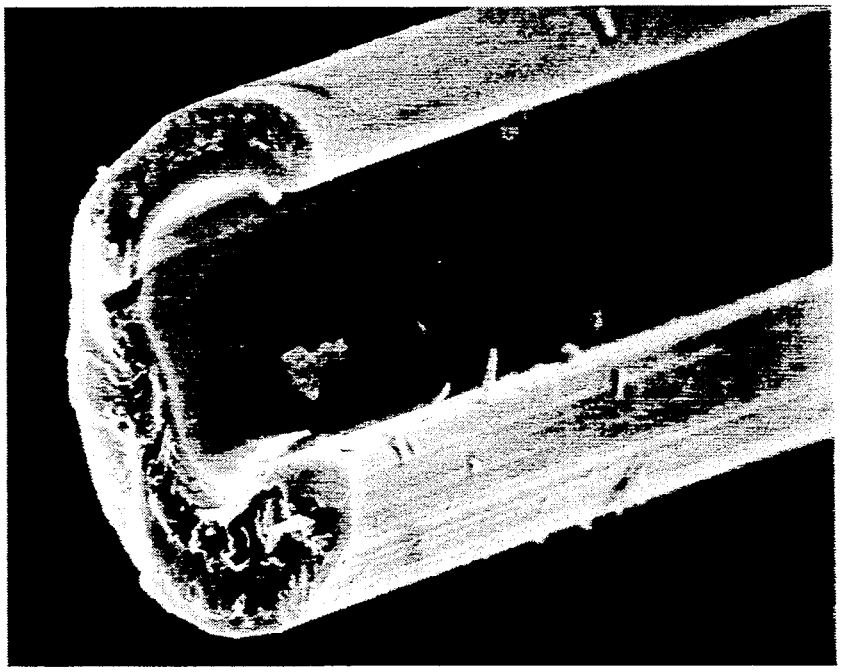
Figure 10:
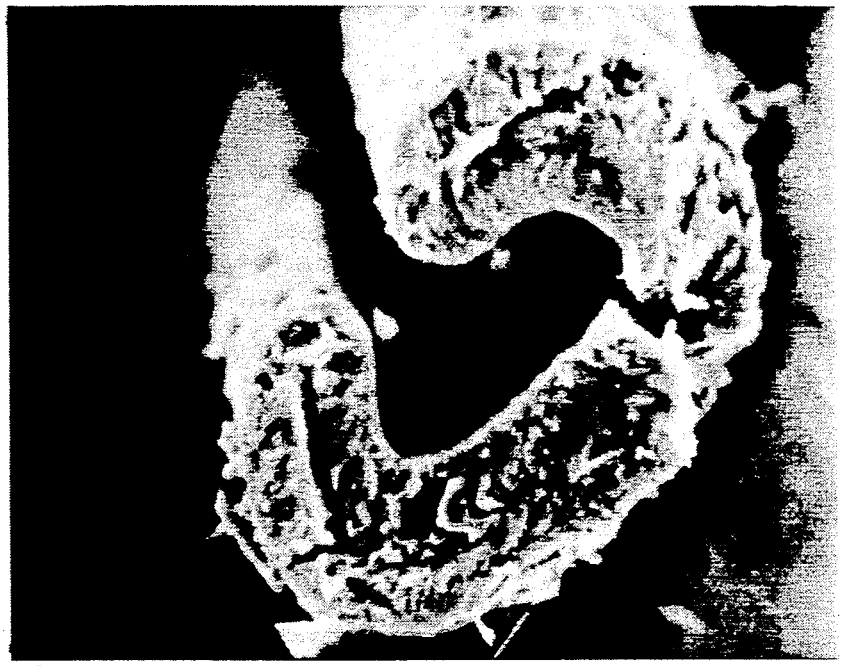
Figure 11:
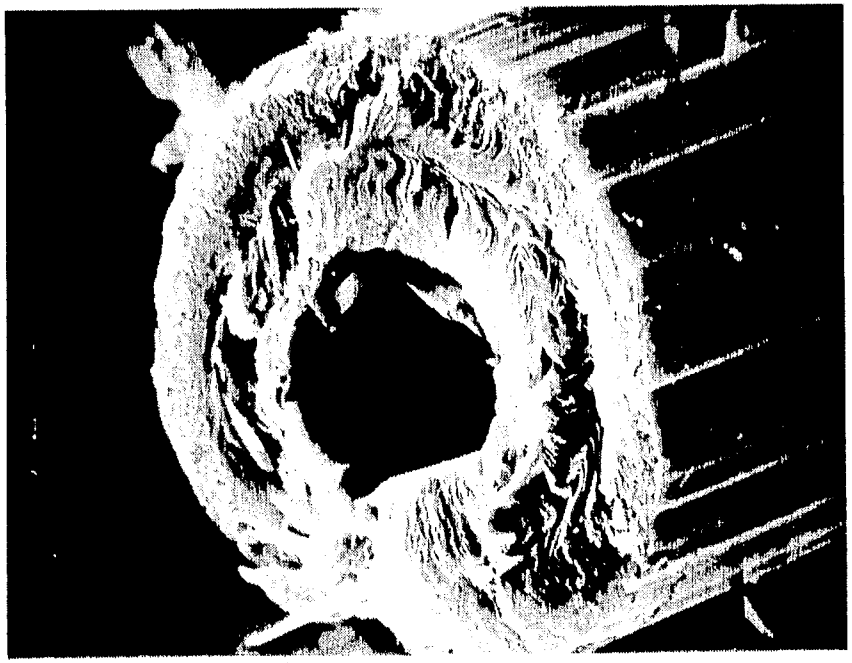

FIG. 6*a* and *b* are a perspective views of an embodiment of a spinneret capillary used in a conventional method for producing C/G fiber and an associated conventional melt spun carbon fiber filament of circular transverse cross-section shown in perspective;

FIG. 7*a* to *e* are a perspective views and a cross-sectional detail view of an embodiment of a spinneret capillary used in an embodiment of the method of the present invention and a number of perspective views of associated carbon fiber filament embodiments of the present invention;

FIG. 8 is a photomicrograph of a plan view of an embodiment of a conventional carbon fiber of solid circular cross-section;

FIG. 9 is a photomicrograph of a perspective view of an embodiment of a carbon fiber according to the present invention;

FIG. 10 is a photomicrograph of a perspective view of an embodiment of a carbon fiber according to the present invention; and FIG. 11 is a photomicrograph of a perspective view of an embodiment of a carbon fiber according to the present invention.

DESCRIPTION OF THE PREFERRED EMBODIMENTS

Reference will now be made in detail to the present preferred embodiments of the invention, examples of which are illustrated in the accompanying drawings.

In accordance with the present invention, a method for producing a high tensile strength carbon fiber, comprises: providing a molten precursor containing a substantial proportion of carbonaceous anisotropic material; extruding the molten precursor through a spinneret defining a capillary having a generally C-shaped cross-sectional area, into a fiber filament; controlling the viscosity of the molten precursor, the pressure of the molten precursor, and the linear take-up speed of the filament to yield a fiber filament having a transverse cross-sectional area substantially like the transverse cross-sectional area of the capillary and further having a line-origin microstructure rendering the fiber filament infusible; and carbonizing the fiber filament, the carbon fiber filament has a line-origin microstructure.

Figure 5:
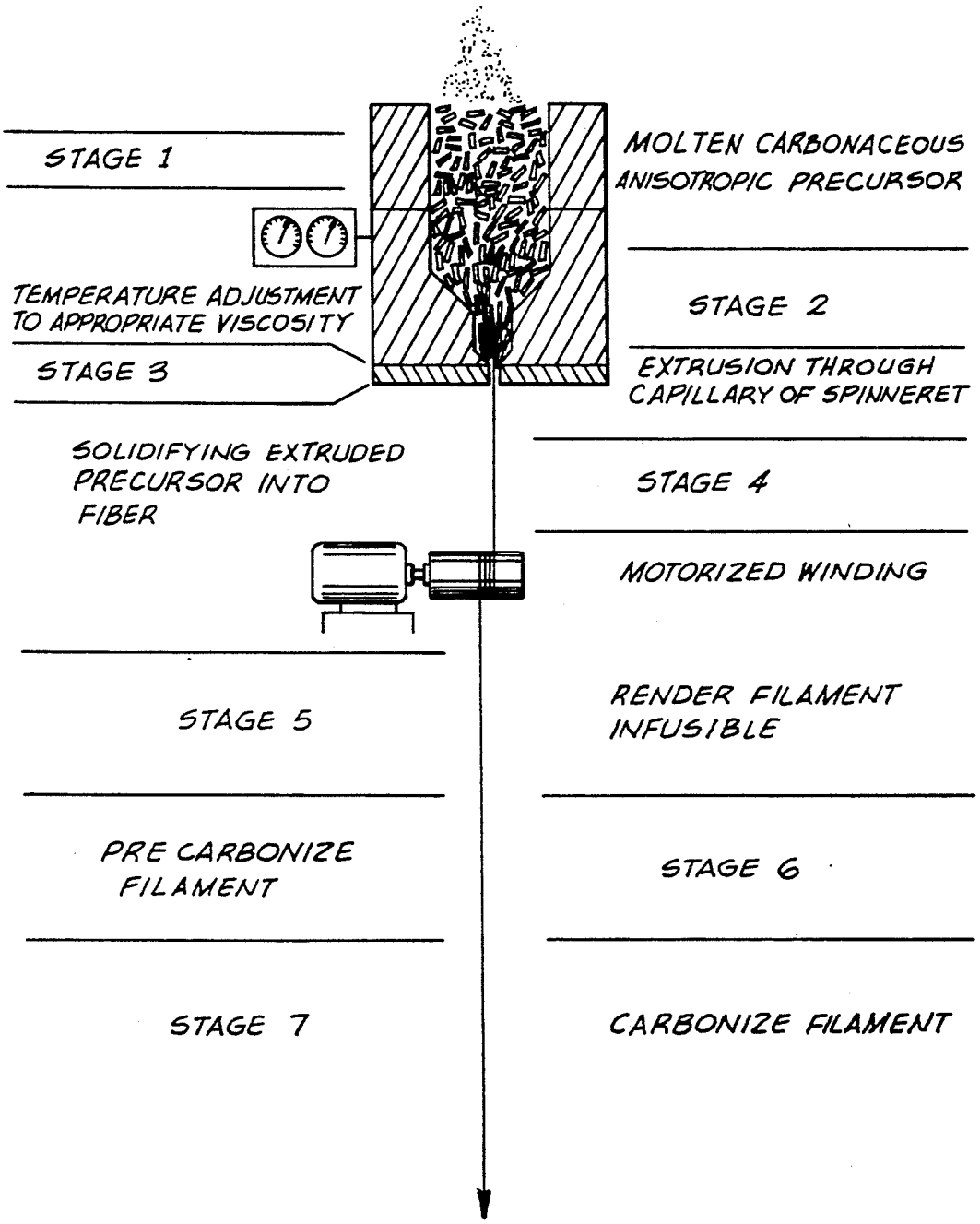
FIG. 5 is a block diagram of an embodiment of the method of the present invention.

Referring to FIG. 5 for example, a preferred embodiment of the method for producing a high tensile strength carbon fiber according too the present invention comprises providing a molten precursor containing a substantial proportion of carbonaceous anisotropic material. A suitable precursor material can be obtained according to the preparations disclosed in U.S. Pat. No. 4,208,267 to Diefendorf et al, entitled, "Forming Optically Anisotropic Pitches," which is hereby incorporated herein by reference. Additional examples of suitable precursor materials are disclosed in each of U.S. Pat. Nos. 4,017,327 and 4,026,788, which are hereby incorporated herein by reference. Other pitch materials suitable for providing precursor material to be used in the method of the present invention include petroleum asphalt, coal tar pitch, and polyvinylchloride.

The spin window is defined as the melt temperature range over which fiber could be spun and adequately taken up on a winder. The spin window will vary depending upon a number of process parameters, including the size of the spinneret capillary and the pressure of the molten precursor. The viscosity of the molten precursor is one of the primary factors governing the spin window. At the lower end of the spin window, the precursor is insufficiently melted and too viscous to be able to expel gas at the fiber surface and then "reheal" during extrusion. Thus, at the lower end of the spin window temperature range, the fiber is porous, brittle and breaks during wind-up. At the upper end of the spin window, the viscosity of the precursor is too low, and it drips through the spinneret instead of extruding as continuous filaments. Over the range of different combinations of operating parameters, the spin window varied over the range of about 300° C. through 340° C. inclusive for the embodiment of the method of the invention used to produce the samples described below. At temperatures below 300° C., the fibers were too brittle, and no fiber sample could be collected. At temperatures of about 350° C. and above, the extruded precursor was too hot, and no fibers could be collected.

However, the particular range for the spin window viscosity can vary with different embodiments of the method of the present invention. For example, the starting viscosity of the precursor material could fluctuate somewhat depending upon the percent weight of carbon in the material and other factors. In addition, the extrusion pressure applied to the precursor, the volumetric flow rate of precursor through the spinneret capillary, the precise shape of the capillary's transverse, cross-sectional area, and the take-up speed of the extruded filament are examples of factors which contribute to the determination of a particular spin window for any given embodiment of the method of the invention.

The average bulk density of the mesophase pitch precursor pellets used in producing the carbon fibers of the present invention and the conventional circular carbon fibers was 0.48 g/cc, and the melt density was about 1.29 g/cc. The ash content was found to be 0.0045 percent. The glass transition temperature was 244° C., while the melting temperature was about 280° C. At the spin window, the viscosity of the melted mesophase pitch precursor is believed to fall in the 500 to 1200 poise range.

In further accordance with the invention, the method for producing high tensile strength carbon fiber, comprises extruding the molten precursor through a spinneret defining a capillary having a generally C-shaped cross-sectional area, into a fiber filament. The molten precursor is extruded into air at room temperature. An embodiment of the process apparatus for practicing an embodiment of the method of the present invention is disclosed in FIG. 4 and differs from a conventional melt spinning apparatus primarily in the shape of the cross-sectional area of the capillary of the spinneret through which the precursor is extruded to form a fiber filament. The C-shaped capillary of the spinneret used in the embodiment of the apparatus shown in FIG. 4 is an example of a spinneret used in a conventional plastic extrusion process.

As shown in FIG. *7a*, an embodiment of a spinneret capillary used in the process apparatus for practicing an embodiment of the method of the present invention has a generally C-shaped cross-sectional area. As shown in FIG. *7e*, the depth of the capillary is generally designated by the letter "T" and constitutes less than the full thickness of spinneret 14. The letter "S" defines the counterbore depth of the spinneret. The outside diameter of capillary 26 is designated by the letter "D" and is measured from top to bottom of the "C" shape of the capillary. The width of the capillary opening is generally indicated by the letter "W." The outside diameter D of a typical capillary of a spinneret such as shown in FIG. *7a* is 1000 um, the inside diameter is 500 um and the width W is 250 um. The perimeter of this typical C-shaped capillary is $40.499\times10^{-4}$ meters compared to $6.283\times10^{-4}$ meters for a typical circular design such as shown in FIG. *6a*. Moreover, the transverse cross-sectional area of the typical C-shaped capillary is $48.605\times10^{-8}$ m$^2$ compared to $3.1415\times10^{-8}$ m$^2$ for the typical circular-shaped capillary. The typical C-shaped capillary described above has 2.4 times more perimeter wall area in contact with the molten precursor than does the circular-shaped design spinneret capillary described above.

Figure 4:
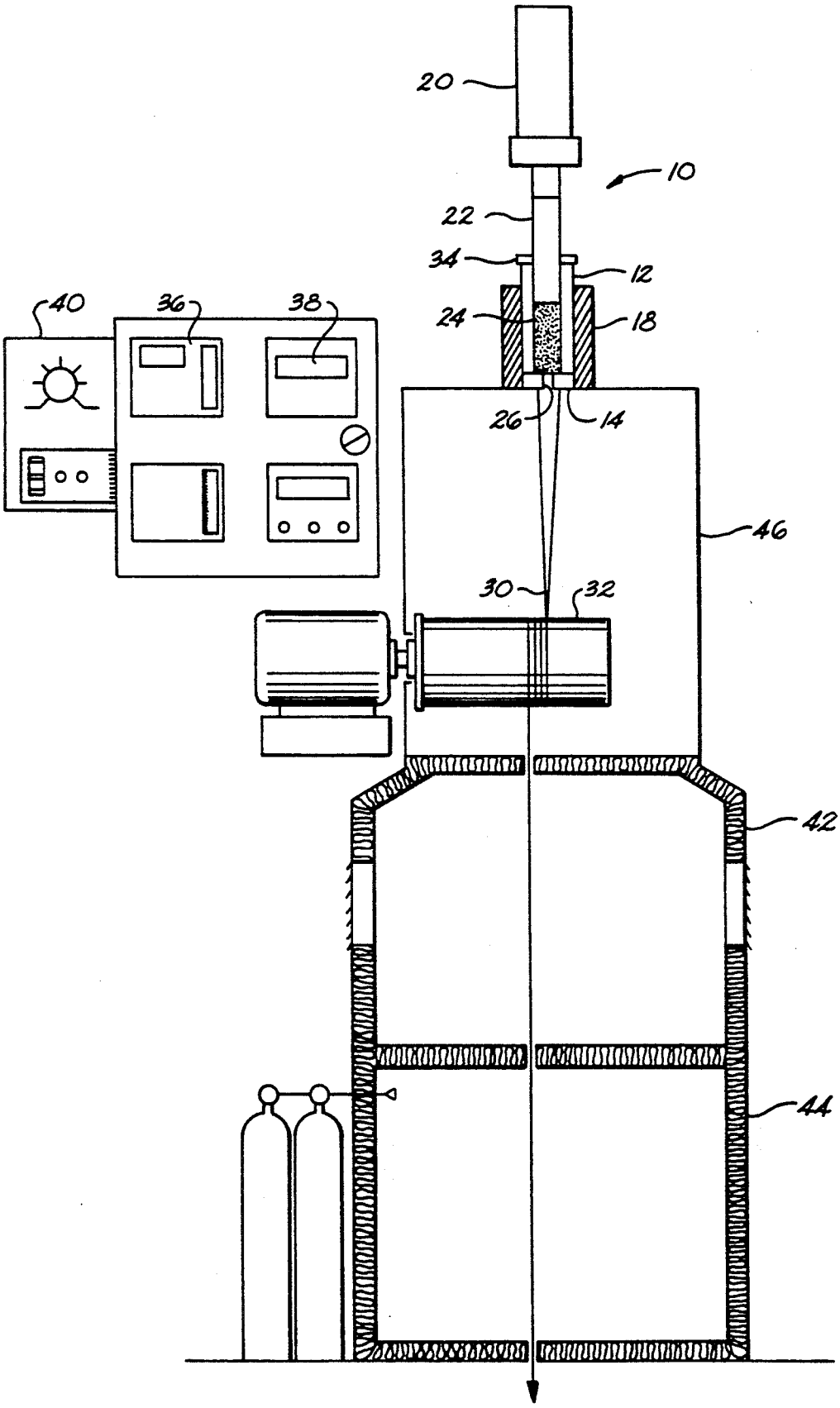
FIG. 4 is a schematic diagram of an embodiment of the process apparatus for practicing an embodiment of the method of the present invention.

The embodiment of the spinneret used in the embodiment of a melt spinning apparatus such as shown in FIG. 4 had four C-shaped openings. Referring to FIG. *7e*, the nominal diameter D of each capillary was 1000 microns. However, one of the capillaries had a diameter of 975 microns, a width W of 150 microns, a depth T of 0.5 mm, and a counterbore S of 11.8 mm. This was the smallest capillary and also was found to be the easiest to use in controlling the apparatus to yield C-shaped and hollow fibers of the present invention. The widths W of the four capillaries varied from 150 microns to 200 microns. Sometimes, one or more of the capillaries was closed off during extrusion, and the number of capillaries open for extrusion was a factor that affected the other operating parameters required to practice the method of the present invention.

In general, the transverse cross-sectional area of a capillary shaped in accordance with the present invention, is characterized by having a linear symmetry rather than a point symmetry. The characteristic of linear symmetry as used in describing the present invention, can best be understood by imagining a uniform shrinking of the perimeter of the transverse cross-sectional area of the capillary. For example, if one were to uniformly shrink the perimeter of a capillary having a circular cross-sectional area, the perimeter would shrink to a single point as the perimeter collapsed to eliminate any circumscribed cross-sectional area. Similarly, a capillary defining a cross-sectional area shaped like a rectangle, would uniformly shrink into a single line which had a length equal to the difference between the length of one of the longer sides of the rectangle and the length of the shorter side of the rectangle. In a similar fashion, a uniform shrinking of the perimeter of the C-shaped cross-sectional area of the capillary shown for the spinneret illustrated in FIG. *7a*, would form a line shaped like a "C".

The C-shaped cross-sectional area of the capillary of FIG. *7a* is believed to exhibit an embodiment of the type of structure which permits the successful extrusion of the carbon fibers of the present invention using the method of the present invention. It is believed that the C-shaped capillary is appropriately employed in the method of the present invention because the C-shaped capillary has a very large perimeter-to-area ratio. In other words, the cross-sectional area of the capillary is defined by a relatively lengthy perimeter relative to the actual cross-sectional area of the capillary. This contrasts with the circular-shaped cross-sectional area of the conventional circular capillaries as shown in FIG. 6*a* for example. In FIG. 6*a*, the perimeter of the cross-sectional area of the capillary constitutes a circle which is the minimum perimeter for that given cross-sectional area. In addition, in the spinneret of FIG. 7*a*, the opposing walls of the capillary are narrowly spaced with respect to each other in relation to the overall length of each opposing wall. In other words, the separation W between the outer C-shaped portion of the capillary perimeter and the inner C-shaped portion of the capillary perimeter is small relative to the length of either C-shaped portion of the perimeter. Even the length of the inner C-shaped perimeter is many times greater than the length of the separation W. By contrast, every two opposing points on the perimeter on a circular-shaped capillary are separated by the maximum distance across the perimeter, namely the diameter. Moreover, the diameter differs from the total length of a semi-circular portion of the perimeter by a distance that is approximately one-half of the diameter.

Figure 6B:
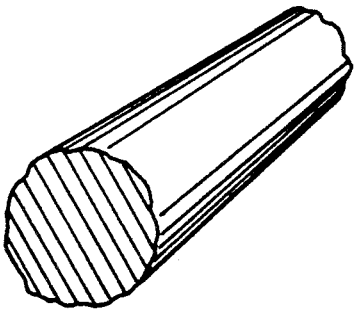
FIG. 6b (PRIOR ART)

As shown in FIG. 6, conventional carbon fiber filaments exhibit the circular cross-sectional area of the conventional circular spinnerets used in extruding same.

In further accordance with the invention, the method for producing a high tensile strength carbon fiber, comprises controlling the viscosity of the molten precursor, the pressure of the molten precursor, and the linear take-up speed of the filament to yield a fiber filament having a transverse cross-sectional area, shaped substantially like the transverse cross-sectional area of the capillary of the spinneret and further having a line-origin microstructure. In the embodiments of the components of the invention depicted in FIGS. 4, 5 and 7, solidification of the filament usually occurs within about one inch from the exit of the spinneret capillary. The exact degree to which the fiber replicates the transverse cross-sectional area shape of the spinneret capillary depends on several factors, including the viscosity and surface tension of the precursor being extruded, the linear take-up speed of the fiber filament, the amount of draw-down, i.e., attenuation, the fiber undergoes upon extrusion, the rate that the fiber is quenched or cooled as it is drawn by a collection device, and the amount of die-swell exhibited by the precursor upon extrusion. For example, rapid cooling rate increases the viscosity of the extruded filament and thereby minimizes the deviation of the shape of the filament from the shape of the capillary cross-sectional shape. Increasing the take-up speed of the fiber filament on a collection device increases the precursor flow at points farthest from the capillary walls and exposes the interior flows to the room temperature air, thus promoting retention of the extruded shape of the filament by facilitating cooling.

The three factors having the greatest influence and at the same time lending themselves to convenient process control, are the viscosity of the molten precursor, because of its dependence on temperature, the pressure of the molten precursor, and the linear take-up speed, because it can be controlled by the pressure applied to the precursor and by the winding speed of the motor which drives a wind-up bobbin 32 (FIG. 4). In the embodiment of the method of the present invention, the temperature of the precursor is monitored so that it may be maintained at a temperature appropriate to ensure that the viscosity of the precursor falls within a range between about 250 poise and about 2000 poise as the precursor is extruded through the spinneret. The spin temperature of the precursor is set, the pressure applied to the molten precursor is set, and the linear take-up speed is adjusted until the fiber filament emerging from the spinneret maintains a cross-sectional area shaped substantially like the cross-sectional area of the capillary of the spinneret. The fibers are then further processed by subjecting them to the heat treatment steps described below, and then transverse cross-sectional areas of the fibers are examined microscopically. If the examination reveals the desired line-origin microstructure (explained below), then the linear take-up speed of the extruded fiber filament, the pressure of the molten precursor, and the temperature of the molten precursor are satisfactory for the other process conditions, such as the composition of the precursor and the dimensions of the spinneret, to yield high strength carbon fibers in accordance with the method and product of the present invention. However, if the microscopic examination reveals a less prominent line-origin microstructure or none at all, then the linear take-up speed and the pressure of the molten precursor are adjusted or the temperature of the molten precursor is changed, depending upon how the fiber extrusion is proceeding. For example, if the extruded fiber is flowing too freely from the capillary, the linear take-up speed can be increased and/or the pressure and temperature of the molten precursor can be decreased.

Figure 7A:
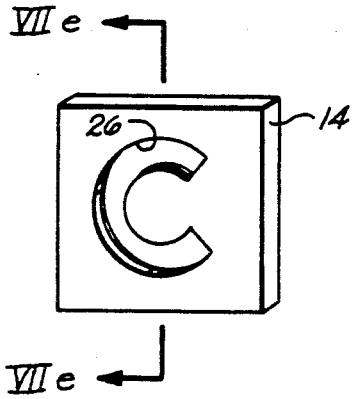
Figure 7B:
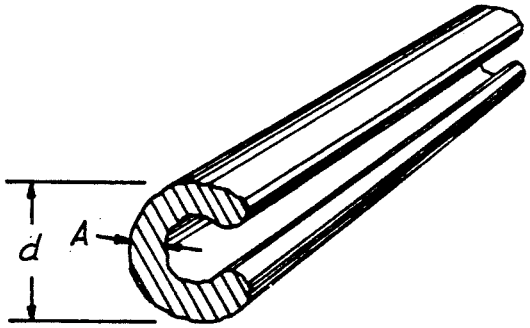
Figure 7C:
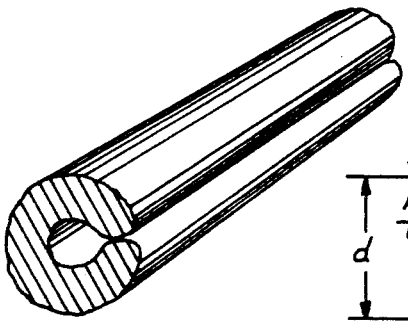
Figure 7D:
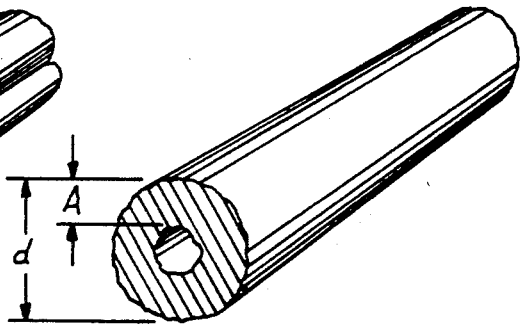
Figure 7E:
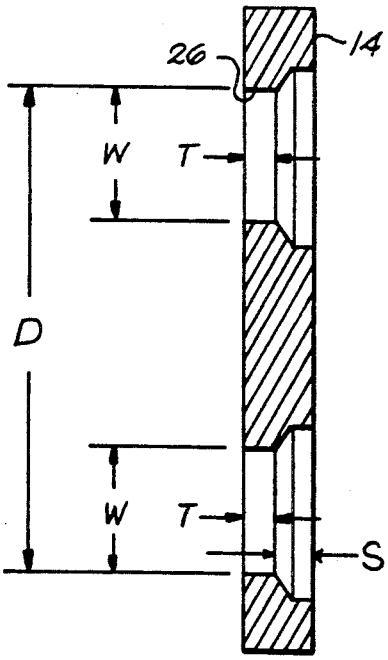

Several process variables can be adjusted to extrude a hollow fiber, which has an annular-shaped cross-sectional area as depicted in FIG. 7*d*, while using a C-shaped capillary, such as depicted in FIG. 7*a*. for example, adjustments can be made to the shape of the spinneret capillary, the width of the capillary, the spinning temperature (precursor viscosity during extrusion), the cooling rate, and the draw-down, i.e., take up, rate. Regarding the shape of the capillary, the closer the two free ends of the C-shaped capillary, the greater the tendency of the extruded precursor to coalesce and merge at the ends into an annular-shaped fiber filament. The annular shape formation of the extruded fiber also improves inversely in proportion to the viscosity of the precursor. The less viscous the precursor, the better the fiber will coalesce and join at the free ends to form a hollow fiber. Raising the spin temperature decreases the melt viscosity. However, the precursor will lose all shape definition after flowing through the spinneret capillaries, if the spin temperature is too high. Preferably, the spin temperature is set near the low end of the spin window while the linear take-up speed is maintained lower than necessary to avoid breakage of the fibers upon wind-up. These conditions are most conducive to extrusion and formation of annular-shaped fiber filaments, sometimes referred to as "hollow" fibers.

It has been observed that in melt spinning, the ability of the fiber to retain the shape of the capillary from which it has been extruded is little influenced by the take-up speed of a winder or other post-extrusion carrier. However, just as with circular fibers, the draw-down rate, i.e., take-up speed of the winder, strongly affects the cross-sectional area of the fiber. As the winder take-up speed is increased, the fiber is stretched by increasing the velocity of the interior portions relative to the perimeter portions, and the cross-sectional area is decreased. In the method of the present invention, the winder was set at a speed equal to or greater than the through-put rate of the pitch precursor. To draw down the fiber diameter of a C-shaped fiber from its size at the capillary of the spinneret to the desired diameter after attenuation, the winder speed was set to a predetermined speed which was just below the winder speed that was too fast to continuously wind fibers without breakage. If a hollow fiber was being formed, a somewhat lower winder speed was set.

FIGS. *7a* and *7e* illustrate a spinneret capillary suitable for use in an embodiment of the method of the present invention. The fiber filaments illustrated in FIGS. 9, 10 and 11 are representative of fiber filaments which can be produced using the spinneret capillary of FIG. *7a* in accordance with the present invention. Moreover, a comparison of FIGS. 9 and 10 illustrates that an identically shaped spinneret capillary cross-sectional area can be used to produce a slightly differently shaped fiber filament. This is accomplished generally by regulating the viscosity of the molten precursor being extruded, the pressure of the molten precursor and/or the cooling rate of the extruded filament.

In further accordance with the invention, the method for producing a high tensile strength carbon fiber, comprises rendering the fiber filament infusible. As embodied herein and shown for example in FIGS. 4 and 5, the filament is rendered infusible by heating the filament in an air atmosphere at about 265° C. to 350° C. for a period of time in the range of one to five hours. Approximately two hours of heating is the preferred oxidation period for the fibers described in the examples below. Thus, the solidified filament is rendered infusible by oxidizing the filament.

In still further accordance with the present invention, the method for producing a high tensile strength carbon fiber, comprises heating the fiber filament in an inert carbonizing environment at a temperature sufficient to substantially increase the tensile strength of the fiber filament. This heating step in an inert, i.e., non-oxidizing, carbonizing environment takes place after the fiber filament has been rendered infusible. As embodied herein and shown for example in FIGS. 4 and 5, the fiber filament is carbonized preferably by raising the filament to a temperature of about 1550° C. to 1600° C. in an oxygen-free atmosphere for approximately five minutes to ten minutes. Preferably, the non-oxidizing environment is a nitrogen atmosphere or other inert, i.e., non-oxidizing, environment, such as argon gas.

In the embodiment of the process apparatus used in performing the method of the present invention, it was found preferable for the carbonizing step to include a pre-carbonizing step in which the fiber filaments were pre-carbonized by heating the fibers in an inert atmosphere for about 30 seconds at a temperature of approximately 750° C. The inert atmosphere preferably comprises nitrogen. However, it is believed possible to eliminate the pre-carbonizing step depending upon the particular process apparatus available for carrying out the method of the present invention. For example, the oxidation temperature could be decreased while increasing the duration of the heat treatment at the lower temperature.

Precarbonization is not necessary, but processing fibers of higher strengths was found to be easier with the embodiments of the apparatus used to demonstrate the method of the present invention, if a precarbonization temperature between 600°–1000° C. is used.

The particular embodiment of the process apparatus described below in carrying out the method of the present invention had a furnace with an upper temperature limitation of approximately 1600° C. It is believed that with a furnace capable of obtaining higher carbonizing temperatures, the tensile strength of the fibers can be increased as long as the carbonizing step is carried out at temperatures higher than 1600° C.

In the batch melt spinning apparatus indicated in FIG. 4 by the numeral 10, a spinneret 14 having at least one capillary 26, such as shown in FIG. *7a*, was attached to a cartridge 12 and filled with a plurality of chips 16 of a pitch precursor. Cartridge 12 comprises a steel cylinder having an 8 cm outside diameter and a 6 cm inside diameter. The cartridge was then heated by means of a heating collar 18, comprising electric current-carrying SiC elements surrounding the cartridge. Back pressure was applied to the pitch precursor by an hydraulic piston 20, which forced a ram 22 down into the cartridge. Once the pitch was melted, this constant pressure hydraulic piston applied a pressure on the order of 100 psi to 500 psi to the molten precursor and extruded the melt 24 through a capillary 26 of spinneret 14 into a quench cabinet 46. The filaments 30 were taken up on a winder bobbin 32, which has a variable speed control 40.

Cartridge 12 was prepared in the following manner. First, anti-seize lubricant was applied to all screws (not shown), the thermocouple (not shown) and the pressure probe connections (not shown). With the cartridge up-side-down, a metal screen (not shown) and an aluminum ring (not shown) were placed in the bottom of the cartridge. A spinneret having a generally C-shaped capillary was screwed into the bottom of the cartridge. With the cartridge right-side-up, the thermocouple and pressure probe were screwed into the side of the cartridge. The cartridge was filled with the solid pitch precursor chips to within one inch from the top. A graphite ring 34 and ram 22 were placed into the top of the cartridge. The cap (not shown) was screwed into the top of the cartridge. Then, the complete cartridge was placed into the heating collar, and the thermocouple and pressure probe leads were connected.

During the spinning process, the desired collar temperature set point was set on a temperature controller 36. The collar temperature, the temperature of the molten precursor, i.e., the melt, and the molten precursor pressure, i.e., the hydraulic pressure, were monitored. The collar controls set point was readjusted as necessary to maintain the desired spin temperature in the melt as read on a melt temperature readout 38. After the desired spin temperature in the melt was attained, the desired melt pressure was set. Preferably, the pressure of the molten precursor was maintained at a constant pressure in the range of 100 psi to 500 psi.

Once the desired melt temperature and melt pressure were obtained, the winder speed necessary to achieve the desired draw-down rate (the reduction of the cross-sectional area of the fiber from that ratio of the spinneret capillary cross-section to a desired cross section) was determined and set on winder speed controller 40. Filaments were collected on the bobbin until an adequate sample had been obtained. The quench air temperature in quench cabinet 46 was monitored.

The oxidation protocol which was followed in operation of the embodiment of the invention illustrated in FIGS. 4 and 5, proceeded as follows. A sample of filament was heated in an oxidation chamber 42 in an air environment at a temperature of between 265° C. and 310° C. for a period of time in the range of one hour to five hours.

In the embodiment of the invention shown in FIGS. 4 and 5, the carbonization protocol proceeded as follows. The oxidized sample of filament was maintained in a furnace 44 for approximately one hour at a temperature of approximately 750° C. Then, during a period of about 30 seconds, the sample was maintained at a temperature in the range of approximately 1550° C. to 1600° C.

In further accordance with the method of the present invention, the carbon fiber filament is examined microscopically at a transverse cross-sectional area thereof to determine whether the desired line-origin microstructure is present. The absence of the desired microstructure requires controlling the temperature of the molten precursor, the pressure of the molten precursor, and/or the linear take-up speed of the extruded filament until the desired line-origin microstructure is obtained. The photomicrographs shown in FIGS. 8–11 were obtained using a scanning electron microscope (SEM). As embodied herein and shown for example in FIGS. 9–11, the line-origin microstructure characteristic of the present invention constitutes the light colored streaks which appear to originate at a line generally located at the symmetrical center region of the transverse cross-sectional area of the fiber. This so-called origin line of the microstructure is located and shaped substantially as a line which constitutes the line formed by uniformally collapsing the perimeter of the transverse cross-sectional area of the fiber filament upon itself.

FIG. 8 shows a typical SEM photomicrograph of 1000 times magnification of a conventional circular carbon fiber produced using the apparatus illustrated in FIG. 4 with a spinneret capillary as shown in FIG. 6*a*. The SEM photo clearly shows that the fiber microstructure is radial in nature. In other words, the crystallites, sometimes referred to as "platelets," (shown in the photo as light colored streaks) emanate from the center, similar to the spokes of a wheel. This radial, point origin structure is typical of solid carbon fibers spun from mesophase pitch and having a circular, transverse cross-sectional area.

The SEM photomicrographs of typical C-shaped fibers are shown in FIGS. 9 and 10. The approximate spin temperatures maintained during extrusion of these fibers was about 340° C. for the fiber shown in FIG. 9 and about 320° C. for the fiber shown in FIG. 10. The fiber shown in FIG. 9 is magnified 1000 times, and the fiber shown in FIG. 10 is magnified 1200 times. Note that the microstructures of these fibers differ from that of the circular fiber shown in FIG. 8. In the C-shaped fibers, the microstructures do not emanate from a center point, but instead emanate from the centerlines of the fibers. This line-origin microstructure of a C-shaped or hollow carbon fiber of the present invention contrasts with the point-origin microstructure of a conventional circular carbon fiber shown in FIG. 8. It is believed that the C-shaped and hollow carbon fibers of the present invention have this line-origin microstructure and will exhibit improved strength over conventional solid carbon fibers of equivalent circular cross-sectional area.

A SEM photomicrograph of a typical hollow carbon fiber according to the present invention is shown in FIG. 11. The temperature of the molten precursor was maintained at about 300° C. near the low end of the spin window during extrusion of this fiber, which is shown in FIG. 11 at 1000 times actual size. Note the light streaked lines emanating from the center line of symmetry of the cross-sectional area of the fiber. Also note that the fracture surface of this fiber exhibits a cup portion, i.e., a depressed portion which appears in the lower portion of the fracture surface shown in the photo. This cup portion is typical of the fracture surface and may indicate an increased strength in the interior portion of the fiber as the cause of the so-called cup and cone fracture surface.

In summary, the embodiment described above of the method of the present invention, proceeded as follows. A petroleum pitch based precursor 24 was prepared by solvent extraction techniques as described in U.S. Pat. No. 4,208,267. The precursor was placed in cartridge 12, melted and maintained at a temperature in the range of approximately 300° C. to 340° C. Next, hydraulic piston 20 was engaged to apply a substantially constant pressure which preferably maintained the melt pressure at a constant pressure in the range of 100 psi to 500 psi. At this constant pressure, precursor 24 was extruded at a constant flow rate through capillary 26 of spinneret 14. The precursor solidified as it emerged from capillary 26 into a room temperature air atmosphere and was wound up on bobbin 32. Solidification of the precursor was observed to have occurred by the time that filament 30 reached a distance of approximately one inch downstream from the capillary oxidizing and carbonizing opening. Then, the fiber filaments were oxidized and carbonized as described above, which were within the range of typical commercial conditions for circular carbon fibers. Finally, the transverse cross-sectional area of the fiber filament can be examined microscopically. If the desired line-origin microstructure is not found, the temperature of the molten precursor, the pressure of the molten precursor, and/or the linear take-up speed of the extruded filament can be adjusted until the desired microstructure is formed.

In further accordance with the present invention, a carbon fiber filament is provided according to the method described above. The carbon fiber filaments produced according to the method described above are characterized by a tensile strength of greater than 200 ksi (thousands of pounds per square inch), either a generally C-shaped transverse cross-sectional area or a generally annular, i.e., hollow one, and the line-origin microstructure described above. Moreover, the carbon fiber filaments of the present invention encompass much larger diameters and cross-sectional areas then conventional carbon fibers of comparable tensile strength. The effective diameter, and a diameter "d" (FIGS. 7*b* and 7*d*) measured from top to bottom of the C-shaped or hollow fibers, is substantially larger than the diameter of circular fibers of equal or lessor tensile strength. Typical top to bottom diameters (d) of C-shaped carbon fibers of the present invention measure in the range of 30 to 50 microns. Typically., the width "A" (FIGS. 7*b* and 7*d*) of the C-shaped portion or annular portion of the transverse cross-sectional areas of the carbon fibers of the present invention, measure on the order of 8 to 15 microns, which is comparable to the diameter of a circular carbon fiber of comparable tensile strength. Width A is sometimes referred to as the wall thickness or web thickness of the C-shaped and hollow fibers of the present invention. The moduli of elasticity (MOE) of the carbon fibers of the present invention typically are in the range of 25 to 35 msi (millions of pounds per square inch) for fibers having a tensile strength on the order of 600 ksi. The MOE's of the carbon fibers of the present invention are significantly lower than the MOE's of circular carbon fibers of much lesser tensile strength.

The moduli of elasticity in the examples which follow were calculated as the slope of the stress versus strain curve generated during the tensile strength measurement.

The conventional circular carbon fiber transverse cross-section shown in plan view in FIG. 8 has a measured diameter of 14.8 microns, a tensile strength of 244.2 ksi and a modulus of elasticity of 35.13 msi. This fiber was produced with the winder running at a speed of 1469 feet per minute. The capillary of the spinneret used to produce this fiber has a diameter of 0.25 millimeters (mm) and a depth of 1 mm. The melt temperature was 358° C. and the melt pressure was 204 pounds per square inch (psi). This fiber was carbonized at a temperature of 1500° C. This particular sample weighted 1.35 grams (g) and was collected over an eight minute time span.

The following examples are presented to illustrate the present invention, but the present invention is not limited to these examples. Each of the examples was prepared according to the above described procedure utilizing a lab scale melt spinning apparatus as illustrated schematically in FIG. 4. The range of the process parameters in the following examples are the same as those described above, unless specifically stated to the contrary in the example.

EXAMPLES

The process apparatus depicted schematically in FIG. 4 and described above was used to produce solid circular conventional carbon fibers, and C-shaped and hollow fibers according to the present invention. Fibers were collected during 26 extrusion runs, during which the pitch precursor material described above was used, and the pressure and temperature of the molten precursor as well as the winder speed were kept within the ranges described above. Each extrusion run with a C-shaped capillary, typically produced so-called open C-shaped fibers such as shown in FIG. 9, partially closed C-shaped fibers such as shown in FIG. 10, and hollow fibers such as shown in FIG. 11, as the temperature and viscosity of the molten precursor varied during the run due to fluctuations in the heat output of the heating collar. Moreover, it is believed that process control would have improved with a capillary of somewhat narrower width W than 150 microns and somewhat increased depth than 0.5 mm.

The object of the laboratory work which generated the examples described below, was to make hollow carbon fibers. It was found for the C-shaped capillaries of the spinneret used to produce the examples, that it was easier to produce C-shaped fibers. Therefore it became a typical procedure to heat the precursor to a specific temperature and pressure selection and collect fibers over a range of winder speeds, from a low winder speed to the highest winder speed that would work without constantly breaking fibers. The samples were collected in petri dishes, stored and gradually processed within the range of oxidation and carbonization times and temperatures described above, as long as the fibers microscopically indicated that they were formed well enough to warrant any additional testing and evaluations.

Forty fibers were selected at random from each of the 26 extrusion runs and fractured on an Instron brand tensile tester. The average load in grams for each run is listed in Table I and represents the average load for between 30 and 40 fibers for each run, because typically about 10 fibers broke during the testing. The fibers tested in the Instron tester for each run were bundled and mounted in epoxy resin, which was polished and viewed with a Beuhler Omnimet image analyzer to determine an average cross-sectional area for the fibers in that particular run. The average cross-sectional fiber area for each run is reported in Table I, along with an average stress in Pascals, which converts to psi when multiplied by a factor of $0.145\times10^{-3}$.

The control was a solid round fiber, such as shown in FIG. 8, and produced during extrusion runs 25 and 26. The diameters of the control fibers were in the 8 to 13 micron range. The control fibers were produced under the same conditions as the hollow and C shapes. The average strengths of the solid round fibers were about 165 ksi at carbonization temperatures in the 1550° C. to 1600° C. range.

After compiling the data presented in Table I, ten additional single fibers were selected from each run that was considered to have fibers left worth testing. The individual tensile strengths of these fibers were measured, and the strengths of the C-shaped fibers are presented in Table II.

There were eleven hollow fibers among the single fibers selected from the 20 extrusion runs presented in Table II, and the individual tensile strengths and cross-sectional areas for these eleven hollow fibers are presented in Table III. Some of these eleven fibers were poorly formed, yet the average tensile strength, including poorly formed fibers, is $13.37\times10^8$ Pascals or 194 ksi. These eleven hollow shaped fibers came from 5 extrusion runs.

The individual C-shaped fibers in each of the 5 extrusion runs from which the eleven hollow fibers were drawn, were selected for purposes of comparison with their hollow shaped brothers. The tensile strengths and cross-sectional areas of these individual C-shaped fibers are presented in Table IV. These C-shaped fibers also include poorly formed fibers, yet the average tensile strength of these 30 C-shaped fibers is about 282 ksi. Since the average tensile strength of the solid circular fibers of the strongest control extrusion run, was 165 ksi, the C-shaped fibers were on average about 70% stronger than the solid circular fibers.

As a general rule, smaller fibers of any shape, are stronger than larger fibers. Table V below presents the tensile strengths and cross-sectional areas for the six individual C-shaped fibers of the extrusion run designated in Table II as Group #6-24#1.

TABLE V

| Tensile strength $\times 10^8$ Pascals | X-sectional area in sq. microns |
|---|---|
| Group #6-24#1 | |
| 59.73 (866 ksi) | 315* |
| 50.30 | 195* |
| 35.14 | 145* |
| 24.39 | 668 |
| 24.06 | 234* |
| 12.22 | 843 |
| average = 34.3 = 497 ksi | average = 400 |

TABLE V-continued

| Tensile strength × $10^8$ Pascals | X-sectional area in sq. microns |
|---|---|
| average* = 42.3 = 613 ksi | average* = 422 |

As shown in Table V, the average strength of the C-shaped fibers of Group #6-24#1 is 497 ksi, which is about 2.3 times the strength of the circular fibers. Moreover, the average strength of the 4 fibers in this group having a cross-sectional area of less than about 350 square microns, is about 613 ksi, which is about 3 times the strength of the circular control fibers. Yet the smallest of these fibers has a cross-sectional area (195 square microns) which is almost twice as large as that of the circular control fibers.

In other extrusion runs of hollow and C-shaped fibers that were reasonable, smaller fibers were found, and these had strengths on the order of 547 ksi, 588 ksi, 685 ksi, 526 ksi, etc. Thus, further strength improvements are expected for smaller C-shaped and hollow fibers, and it is believed that smaller fibers can be produced in accordance with the present invention by employing a spinneret having a smaller capillary opening than was available for producing the examples reported above.

The extrusion run of Group #6-24#1 was drawn at a surface speed of about 800 ft./min. when the molten precursor temperature was in the range of about 300° C. to 340° C. The pressure of the molten precursor was in the range of about 150 to 200 psi. The fibers were oxidized for one hour between 305° to 315° C. in air, precarbonized for about one minute at 750° C. in 12 cubic feet per hour of nitrogen gas (CFH $N_2$) and carbonized between 1550° C. and 1600° C. for five minutes in 12 CFH $N_2$.

In general, it was found that hollow shaped fibers are produced easier when the temperature of the molten precursor is operating at the lower end of the spin window range of 300° C. to 340° C. As the temperature of the molten precursor is increased, the C shapes tend to become more open. Microstructure control is best produced at lower precursor pressures and higher winder speeds. When the precursor pressure is increased, the fibers look good when first spun, but typically do not produce good fibers after carbonization. The spinneret capillary is important, and if the size of the capillary opening or the number of spinneret capillaries open for extrusion is changed, all of the control parameters change.

Figure 1:
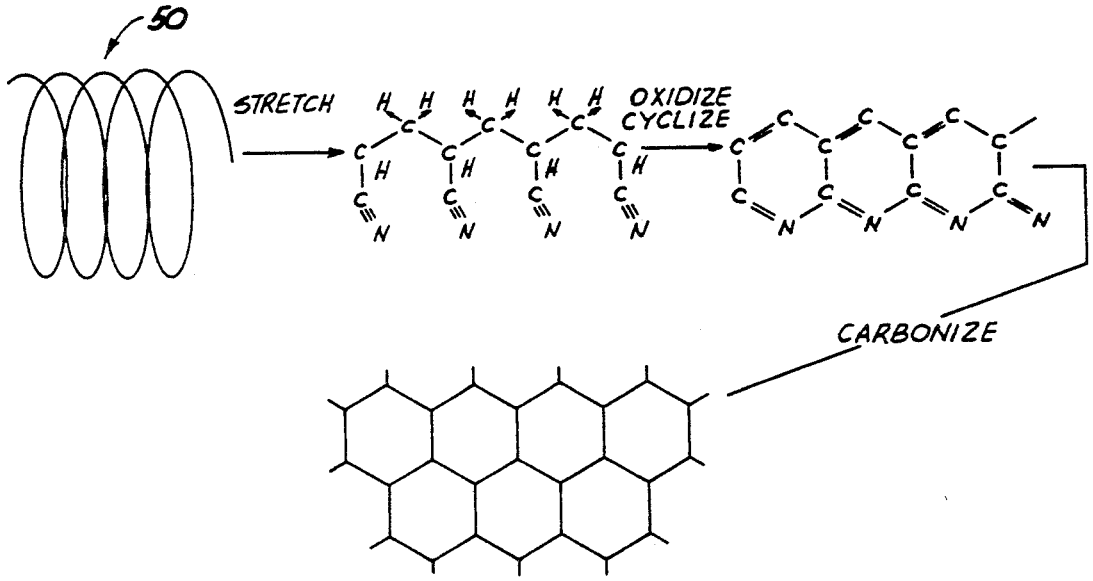
FIG.1 (PRIOR ART)
FIG. 1 is a schematic diagram of a conventional PAN-based process for producing a circular cross-section C/G fiber.
Figure 2:
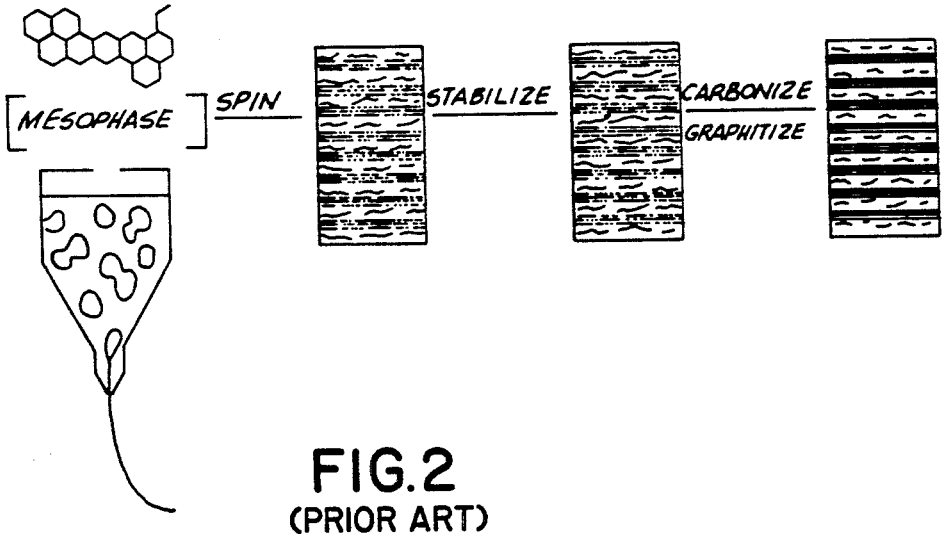
FIG.2 (PRIOR ART)
FIG. 2 is a schematic diagram of a conventional mesophase pitch-based process for producing a circular cross-section C/G fiber.
Figure 3:
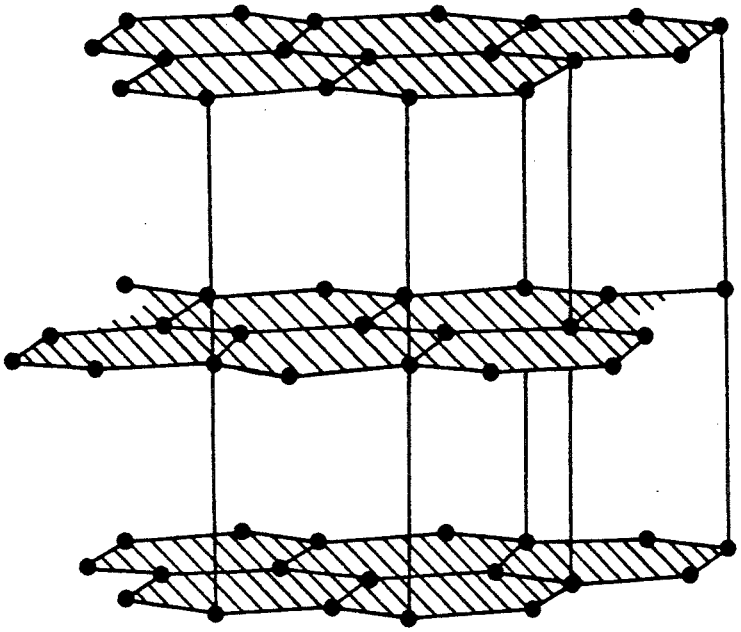
FIG. 3 is a schematic diagram of the molecular structure of graphite.

It is believed that the line-origin microstructure of the carbon fibers of the present invention is indicative of an improved alignment and preferred orientation of a greater percentage of the asphaltene platelets, sometimes referred to as crystallites, that are present within the mass of the melt-spun fiber. The structures resembling "chicken wire" shown in FIGS. 1 and 2 are examples of the type of microstructures that one would expect to be found within the liquid crystals or mesophase pitch, which is used as the precursor in the present invention. This "chicken wire" is the part of the mesophase pitch referred to as an asphaltene platelet, or as an aromatic ring. The light streaked portions of the photomicrographs of FIGS. 8, 9, 10 and 11 are believed to be an alignment of the platelets around a line of symmetry of the fiber. The strength of the fibers is considered to increase in direct proportion to the degree to which the adjacent platelets are aligned in a parallel fashion relative to each other. By contrast, the radial alignment of platelets in the center section of a conventional carbon fiber (FIG. 8) are aligned in non-parallel fashion and approach a more random or amorphous alignment. Only the microstructure near the outer peripheral surface of the conventional circular carbon fiber has any degree of parallel alignment of the platelets.

The alignment of platelets that occurs in fibers during extrusion is believed to be caused by the shear stresses generated in the melt. It is believed that greater contact with the capillary wall causes more shear stress during extrusion and a commensurately better alignment of platelets. These stresses occur because the molten precursor nearest the capillary wall of the spinneret has the lowest velocity, while the molten precursor flowing through the center portion of the capillary has the highest velocity of the velocity profile of the extruding precursor. Thus, the platelet alignment should therefore increase as the ratio of the capillary wall perimeter to the fiber cross-sectional area increases.

When a fiber of circular transverse cross-sectional area is extruded through the circular spinneret capillary, there is less fiber surface area contacting the capillary wall than when the molten precursor is extruded through a capillary having a C-shaped transverse cross-sectional area. The ratio of the capillary's perimeter to its cross-sectional area is larger for the C-shaped design than for a capillary having a circular cross-sectional area.

However, it is also believed that the gas evolved during the oxidation step and the elevated carbonization step may reorient the preferential alignment of platelets which results due to the shear stresses between the molten precursor and the spinneret wall which defines the capillary through which the molten precursor is being extruded. The gasses which diffuse from a fiber having a circular cross-sectional area, diffuse radially outwardly from the center. By contrast, the gas evolution through a fiber having a C-shaped cross-sectional area is normal to the centerline such that there is evolution from the center core in only two directions.

When the fibers are heated above 1000° C., relaxation occurs, and the alignment of platelets becomes partially disoriented. This phenomenon is corrected as the temperature is increased, and the alignment is thermally set at temperatures above 1200° C. The line-origin cores present in the fibers of the present invention having C-shaped or annular-shaped cross-sectional areas may be indicative of gasses diffusing normal to this centerline, thereby producing the microstructural paths comprised of platelets aligned perpendicular to the peripheral surface of the fibers. The continuous centerline core of the C-shaped and annular-shaped fibers is believed to have less random alignment of platelets than the center core of a circular fiber. Thus, it is expected that the C-shaped and annular-shaped fiber cores will be stronger than the center portion of a circular fiber.

Another factor which may contribute to the improved strength of the C-shaped and hollow fibers may be the shorter distance required for oxygen diffusion during the oxidation of a C-shaped or hollow fiber versus a circular fiber of equivalent cross-sectional area. Because the C-shaped or hollow fiber has a greater surface-to-volume ratio, there is more surface available for oxygen to diffuse into the fiber during oxidation. Moreover, because of its C or annular shape, no portion of the respective C-shaped or hollow fiber is as thick as the circular fiber of equivalent area. Thus, the oxygen travels a shorter distance in the C-shaped or hollow fiber than the oxygen must travel in the circular fiber to reach the core. In other words, for any given oxidation conditions, such as time and temperature, one would expect the greater surface area and the thinner bodies of the C-shaped and hollow fibers to allow a greater degree of cross-linking and accordingly cause these fibers to better retain their liquid crystalline orientation through the high temperature carbonization step. Such retention of crystalline orientation is essential for the high strength and stiffness of the carbonized fibers.

The C-shaped and hollow carbon fibers of the present invention have several advantages over the conventional carbon fiber of circular cross-section. One advantage of the C-shaped and hollow carbon fibers of the present invention is the larger surface area to volume present in the C-shaped and hollow fibers. This characteristic should improve the wetability of the fiber, and this should yield improved performance in applications where wetability is important. To facilitate comparisons between the conventional circular carbon fibers and the C-shaped and hollow fibers of the present invention, the effective diameter of a non-circular fiber is defined as the diameter of a hypothetical circular fiber with an equivalent cross-sectional area. For a given effective diameter, the C-shaped and hollow fibers can be spun with a larger cross-sectional area than a circular fiber.

Another advantage of the C-shaped and hollow fibers is the ability to extrude larger fibers bulk wise with less fiber breakage, because gaseous impurities are more easily released over the larger surface area. The larger cross section of the C-shaped and hollow fibers allows the fibers to sustain greater loads during spinning. Production of larger fibers at a given winder take-up speed, permits a greater spinning process throughout.

The C-shaped and hollow fibers of the present invention are stronger, i.e., greater tensile strength and than a circular fiber of comparable diameter. The C-shaped and hollow fibers of the present invention are stronger than conventional circular carbon fibers which are carbonized at temperatures above 1600° C. For example, a C-shaped carbon fiber of the present invention that is carbonized at 1600° C. is stronger than a circular carbon fiber of comparable diameter and which is also carbonized at 1900° C.

Typically, carbon pitch fibers when carbonized in the range of 1500° C. to 1600° C. have a modulus of elasticity (MOE) of 30 to 40 million pounds per square inch (msi). When heated to higher temperatures like 2100° to 2800° C., the MOE values typically increase to 80 to 100 msi. The C-shaped and hollow fibers of the present invention, even though stronger than solid fibers of circular cross-section, tend to have MOE values that are lower. The highest measured MOE's for individual fibers of the present invention are 25–35 msi for C-shaped and hollow fibers having tensile strengths greater than 600 ksi.

It will be apparent to those skilled in the art that various modifications and variations can be made in the carbon fiber and method for producing same without departing from the scope or spirit of the invention. Thus, it is intended that the present invention cover the modifications and variations come within the scope of the appended claims and their equivalents.

TABLE I

Average Fracture Loads and Cross-sectional Areas of Carbonized Fibers

| | Run No. | | Fiber Shape | Average Cross Sectional Area $\mu m^2$ | Average Load grams | Average Stress $\times 10^8$ Pa |
|---|---|---|---|---|---|---|
| 1 | 3-1-85 | | Hollow* | 395.66 | 38.31 | 9.487 |
| 2 | 4-16 | | " | 608.77 | 36.47 | 5.877 |
| 3 | 5-9 | B2 | " | 514.04 | 26.81 | 5.111 |
| 4 | 5-9 | B8 | " | 425.49 | 20.75 | 4.779 |
| 5 | 5-9 | 42 | " | 510.75 | 23.16 | 4.443 |
| 6 | 5-24 | C3 | " | 451.55 | 24.91 | 5.406 |
| 7 | 6-7#2 | | | 1531.26 | 47.84 | 3.062 |
| 8 | 6-18#2 | | X | 1002.94 | 59.04 | 5.769 |
| 9 | 6-18#2 | 23 | X | 667.89 | 114.57 | 16.810 |
| 10 | 6-18#2 | 32 | X | 748.80 | 46.03 | 6.020 |
| 11 | 6-21 | A1 | C | 659.00 | 70.76 | 10.523 |
| 12 | 6-21#6 | | C | 457.42 | 64.83 | 13.891 |
| 13 | 6-21#7 | | C | 530.64 | 59.70 | 11.025 |
| 14 | 6-24#1 | | C | 374.69 | 79.54 | 20.804 |
| 15 | 6-24#1 | 20 | C | 1142.70 | 86.83 | 7.446 |
| 16 | 6-24#1 | 37 | C | 661.53 | 92.92 | 13.764 |
| 17 | 6-24#2 | | C* | 1410.13 | 60.19 | 4.183 |
| 18 | 6-24#2 | 24 | C* | 1454.35 | 80.62 | 5.432 |
| 19 | 6-24#2 | 31 | C* | 971.18 | 96.97 | 9.778 |
| 20 | 6-26#1 | | X* | 745.35 | 93.62 | 12.309 |
| 21 | 6-26#1 | 21 | X* | 727.17 | 75.50 | 10.175 |
| 22 | 6-26#1 | 38 | X* | 938.05 | 43.32 | 4.525 |
| 23 | 6-27 | 27 | X | 561.64 | 35.05 | 6.114 |
| 24 | 6-27 | 36 | X | 826.87 | 50.68 | 6.006 |
| 25 | 7-22 | 25 | Z | 90.89 | 9.50 | 10.242 |
| 26 | 7-22 | 41 | Z | 114.32 | 11.81 | 10.124 |

*Poorly formed X C's and Hollows mixed
Z solid circular

TABLE II

Tensile Strengths of Individual C-shaped Fibers

Strengths of single fibers [$\times 10^8$ Pascals]

| Group # | | | | |
|---|---|---|---|---|
| 3-1-85 | 5-9 B2 | 5-24 | 6-7#2 | 6-18#2 |
| 21.13 | 27.18 | 13.10 | 21.02 | 13.32 |
| 12.30 | 11.02 | 6.02 | 5.95 | 11.78 |
| 11.73 | 7.68 | 5.83 | 3.69 | 6.40 |
| 6.19 | 6.51 | 2.45 | 2.78 | 2.95 |
| 1.23 | 2.34 | | | 2.94 |
| **Group #** | | | | |
| 6-18#2 23 | 6-18#2 32 | 6-21 A1 | 6-21#6 | 6-21#7 |
| 34.61 | 9.03 | 37.78 | 40.56 | 38.74 |
| 24.88 | 7.59 | 37.73 | 26.66 | 17.37 |
| 21.08 | 4.81 | 20.22 | 20.49 | 13.41 |
| 19.74 | 1.45 | 17.10 | 20.25 | 13.24 |
| 18.94 | | 15.59 | 11.30 | 12.03 |
| 16.54 | | 12.41 | 10.08 | |
| 14.26 | | 11.79 | | |
| | | 3.82 | | |
| **Group #** | | | | |
| 6-24#1 | 6-24#1 20 | 6-24#1 37 | 6-24#2 | 6-24#2 24 |
| 59.73 | 47.27 | 22.53 | 22.58 | 25.66 |
| 50.30 | 20.17 | 12.54 | 10.72 | 17.09 |
| 35.14 | 16.84 | 9.29 | 8.93 | 14.89 |
| 24.39 | 16.66 | 7.64 | 7.59 | 10.98 |
| 24.06 | 15.06 | 6.46 | 3.68 | 10.19 |
| 12.22 | 14.82 | 5.68 | | 9.08 |
| | 9.93 | 1.62 | | 6.17 |
| | 3.29 | | | |
| **Group #** | | | | |
| #6-24#2 31 | 6-26#1 | 6-26#1 21 | 6-26#1 38 | 6-27 27 |
| 20.56 | 32.13 | 36.25 | 29.79 | 14.07 |
| 6.47 | 24.17 | 26.09 | 12.53 | 10.88 |
| 5.43 | 21.05 | 25.67 | 9.54 | 9.21 |
| | 2.46 | 22.13 | 7.02 | |
| | 2.29 | 21.39 | 5.13 | |
| | | 15.66 | | |
| | | 9.94 | | |
| | | 6.51 | | |

TABLE III

| Actual Tensile Strengths of Individual Hollow Fibers | | | |
|---|---|---|---|
| Strength × $10^8$ Pa | | Area $\mu m^2$ | |
| 1.23 | | 478 | |
| 3.82 | | 308 | |
| 7.02 | | 377 | |
| 9.54 | | 452 | |
| 9.94 | | 710 | |
| 11.79 | | 300 | |
| 17.10 | | 424 | |
| 19.74 | | 542 | |
| 20.22 | | 286 | |
| 21.08 | | 948 | |
| 25.67 | | 355 | |
| average | 13.37 | average | 470.91 |
| standard deviation | 7.87 | standard deviation | 201.15 |

TABLE IV

| Actual Tensile Strengths of Individual C-shaped Fibers | | | |
|---|---|---|---|
| Stress × $10^8$ Pa | Area $\mu m^2$ | Stress × $10^8$ Pa | Area $\mu m^2$ |
| 3.3 | 685 | 16.6 | 882 |
| 5.1 | 382 | 16.8 | 762 |
| 6.2 | 571 | 18.9 | 688 |
| 6.5 | 482 | 20.2 | 408 |
| 9.9 | 276 | 21.1 | 154 |
| 11.7 | 259 | 21.4 | 458 |
| 12.3 | 215 | 22.1 | 435 |
| 12.4 | 371 | 24.8 | 642 |
| 12.5 | 344 | 26.1 | 308 |
| 14.3 | 591 | 29.7 | 250 |
| 14.8 | 562 | 34.6 | 538 |
| 15.1 | 566 | 36.2 | 319 |
| 15.6 | 353 | 37.7 | 200 |
| 15.6 | 563 | 37.7 | 218 |
| 16.5 | 698 | 47.2 | 340 |
| average stress | 19.446 | average area | 450.66 |
| standard deviation | 10.77 | standard deviation | 188.07 |

What is claimed is:

1. A method for producing a high tensile strength carbon fiber, comprising:

providing a molten precursor containing a substantial proportion of carbonaceous anisotropic material;

extruding said molten precursor through a spinneret defining a capillary having a generally C-shaped cross-sectional area, into a fiber filament;

controlling the viscosity of said molten precursor, the pressure of said molten precursor, and the linear take-up speed of said filament to yield a fiber filament having an annular transverse cross-sectional area and further having a line-origin microstructure;

rendering said fiber filament infusible; and carbonizing said fiber filament.

2. The method of claim 1, wherein:

said origin line of said microstructure is located and shaped as a line which constitutes the line formed by uniformly collapsing the perimeter of the transverse cross-sectional area of said fiber filament upon itself.

3. The method of claim 1, wherein:

the viscosity of said molten precursor is at least partially controlled by controlling the temperature of said molten precursor.

4. The method of claim 3, wherein:

the linear take-up speed of said filament is maintained within the range of 800 feet per minute to 1500 feet per minute to attenuate said filament; and the temperature of said molten precursor is maintained within the range of 300° C. to 340° C.

5. The method of claim 1, wherein:

said step of carbonizing said fiber filament includes heating said fiber filament in an inert pre-carbonizing environment for a period of approximately 1 to 5 minutes, said pre-carbonizing environment having a temperature within the range of approximately 600° C. to 1000° C.

6. The method of claim 1, wherein said step of carbonizing said fiber filament includes heating said fiber filament in an inert carbonizing environment for a period of approximately 5 to 10 minutes, said carbonizing environment having a temperature in excess of approximately 1550° C.

7. The method of claim 1, wherein:

said step of rendering said fiber filament infusible includes maintaining said fiber filament in an oxidizing environment for a period of time in the range of approximately 1 to 5 hours, said oxidizing environment being maintained at a temperature in the range of approximately 265° C. to 350° C.

8. The method of claim 1, wherein:

said fiber filament constitutes a carbon fiber having higher tensile strength than a solid carbon fiber of circular cross-sectional area melt spun under the same process conditions as above except for the use of a circular spinneret instead of a C-shaped spinneret.

9. The method of claim 1, wherein:

said fiber filament constitutes a carbon fiber having higher tensile strength than a solid circular carbon fiber of equivalent cross-sectional area and produced under the same process conditions as above except for the use of a circular spinneret instead of a C-shaped spinneret.

10. A carbon fiber filament according to the method of claim 1.

11. A method for producing a high tensile strength carbon fiber, comprising:

providing a molten precursor containing a substantial proportion of carbonaceous anisotropic material;

extruding said molten precursor through a spinneret defining a capillary having a generally C-shaped cross-sectional area, into a fiber filament;

controlling the viscosity of said molten precursor, the pressure of said molten precursor, and the linear take-up speed of said filament to yield a fiber filament having a hollow interior and further having a line-origin microstructure;

rendering said fiber filament infusible; and carbonizing said fiber filament.

12. The method of claim 11, wherein:

the viscosity of said molten precursor is at least partially controlled by controlling the temperature of said molten precursor.

13. The method of claim 11, wherein:

said step of carbonizing said fiber filament includes heating said fiber filament in an inert carbonizing environment for a period of approximately 5 to 10 minutes, said carbonizing environment having a temperature in excess of approximately 1550° C.

14. The method of claim 11, wherein:

said step of carbonizing said fiber filament includes heating said fiber filament in an inert pre-carbonizing environment for a period of approximately 1 to 5 minutes, said pre-carbonizing environment having a temperature within the range of approximately 600° C. to 1000° C.

15. The method of claim 11, wherein:

the linear take-up speed of said filament is maintained within the range of 800 feet per minute to 1500 feet per minute to attenuate said filament.

16. The method of claim 11, wherein:

the temperature of said molten precursor is maintained within the range of 300° C. to 340° C.

17. The method of claim 11, wherein:

said step of rendering said fiber filament infusible includes maintaining said fiber filament in an oxidizing environment for a period of time in the range of approximately 1 to 5 hours, said oxidizing environment being maintained at a temperature in the range of approximately 265° C. to 350° C.

18. The method of claim 11, wherein:

said fiber filament constitutes a carbon fiber having higher tensile strength than a solid carbon fiber of equivalent cross-sectional area melt spun under the same process conditions as above except for the use of a circular spinneret instead of a C-shaped spinneret.

19. The method of claim 11, wherein:

said fiber filament constitutes a carbon fiber having higher tensile strength than a conventional solid carbon fiber which is produced by a conventional carbon fiber processing technique except that the temperature of the carbonizing environment used to process the conventional carbon fiber is at least 300° C. higher than the carbonizing environment temperature above and a spinneret with a circular cross-section is used to produce the conventional fiber instead of a spinneret with a C-shaped cross-section.

20. A carbon fiber filament according to the method of claim 11.

* * * * *